US008597758B2

(12) United States Patent
Kaminer et al.

(10) Patent No.: US 8,597,758 B2
(45) Date of Patent: Dec. 3, 2013

(54) PAD FOR A STEAM APPLIANCE

(75) Inventors: Brian F. Kaminer, Harrison, NY (US); Latha Kalpala, Hopkinton, MA (US)

(73) Assignee: Euro-Pro Operating LLC, Newton, MA (US)

( * ) Notice: Subject to any disclaimer, the term of this patent is extended or adjusted under 35 U.S.C. 154(b) by 231 days.

(21) Appl. No.: 12/722,989

(22) Filed: Mar. 12, 2010

(65) Prior Publication Data

US 2011/0223375 A1 Sep. 15, 2011

(51) Int. Cl.
*B32B 3/06* (2006.01)

(52) U.S. Cl.
USPC ..... 428/100; 428/98; 428/99

(58) Field of Classification Search
USPC ..... 428/100, 99, 98
See application file for complete search history.

(56) References Cited

U.S. PATENT DOCUMENTS

| | | | |
|---|---|---|---|
| 4,114,223 | A | 9/1978 | Buchanan |
| 5,177,831 | A | 1/1993 | Wirth |
| 5,715,561 | A | 2/1998 | Tuthill et al. |
| 5,887,311 | A | 3/1999 | Kresse et al. |
| 6,389,637 | B1 | 5/2002 | Hurell |
| 6,810,554 | B2 | 11/2004 | McKay |
| 7,487,567 | B2 | 2/2009 | Kresse et al. |
| 7,600,401 | B2 | 10/2009 | Rosenzweig |
| 7,996,948 | B2 | 8/2011 | Kaminer et al. |
| 2005/0283934 | A1 | 12/2005 | Amatucci |
| 2006/0000049 | A1 | 1/2006 | Rosenzweig |
| 2006/0000241 | A1 | 1/2006 | Rosenzweig |
| 2008/0066789 | A1 | 3/2008 | Rosenzweig et al. |
| 2008/0168614 | A1 | 7/2008 | Guohua |
| 2009/0320231 | A1 | 12/2009 | Rosenzweig et al. |
| 2010/0024146 | A1* | 2/2010 | Rosenzweig et al. ..... 15/228 |
| 2010/0269282 | A1 | 10/2010 | Kaminer et al. |
| 2010/0272948 | A1* | 10/2010 | Kaminer et al. ..... 428/100 |
| 2011/0296633 | A1 | 12/2011 | Kaminer et al. |

FOREIGN PATENT DOCUMENTS

| | | | |
|---|---|---|---|
| DE | 4427672 | A1 | 2/1996 |
| DE | 29910658 | U1 | 9/1999 |
| EP | 1 704 808 | A1 | 9/2006 |
| KR | 10-0574743 | B1 | 4/2006 |
| KR | 20-0416393 | Y1 | 5/2006 |
| KR | 20-0428580 | Y1 | 10/2006 |
| KR | 10-2008-0106745 | A | 12/2008 |

OTHER PUBLICATIONS

International Search Report and Written Opinion for PCT/US2009/044294 mailed Mar. 19, 2010.
International Search Report and Written Opinion for PCT/US2009/044295 mailed Apr. 6, 2010.
International Search Report and Written Opinion for PCT/US2011/027544 mailed Nov. 30, 2011.

* cited by examiner

*Primary Examiner* — Brent O'Hern
(74) *Attorney, Agent, or Firm* — Wolf, Greenfield & Sacks, P.C.

(57) ABSTRACT

A steam permeable pad for a steam appliance, such as a steam mop or garment press. The pad includes an outer fabric layer and an internal steam management layer which may include a terry fabric. The pad may further include a laminate of jerry fabric, cushioning knit, and open mesh. An attachment feature allows the pad to be mounted to a head or frame of the steam appliance.

14 Claims, 2 Drawing Sheets

PAD FOR A STEAM APPLIANCE

FIELD

The invention relates to a pad for a steam appliance, such as a steam cleaner, iron or a garment press.

BACKGROUND

Steam treating appliances, such as steam cleaners, garment presses and irons, emit steam through a nozzle or other outlet against a surface to be treated. It is known to position a steam permeable pad over the steam outlet, and to contact the pad against the floor, surface, or garment/upholstery to be treated. Moisture in the steam and moisture accumulation in the pad may leave the treated surface wet. An objective of this invention is to provide a steam permeable pad that hastens drying of the treated surface.

SUMMARY

In one aspect of the invention, a pad is provided for mounting to a head or a frame of a steam appliance, and includes a steam permeable pad body having a steam treatment surface portion and a steam introduction portion. The pad body includes a quick drying steam permeable outer fabric layer and a steam permeable terry fabric layer, with the steam permeable terry fabric layer being located between the steam introduction portion and the outer fabric layer. The pad body includes an attachment feature to mount to a head or a frame of a steam appliance.

In another aspect of the invention, a pad is provided for mounting to a head or a frame of a steam appliance. The pad includes a quick drying steam permeable outer fabric layer and a fabric-based steam management system to remove moisture from steam admitted into the pad before it reaches the steam permeable outer layer. An attachment feature is provided to mount the pad to a head or frame of a steam appliance.

BRIEF DESCRIPTION OF DRAWINGS

Other aspects, advantages and novel features will become more apparent from the following detailed description of embodiments of the invention when considered in conjunction with the accompanying drawings wherein.

DESCRIPTION OF EMBODIMENTS

Figure 1:
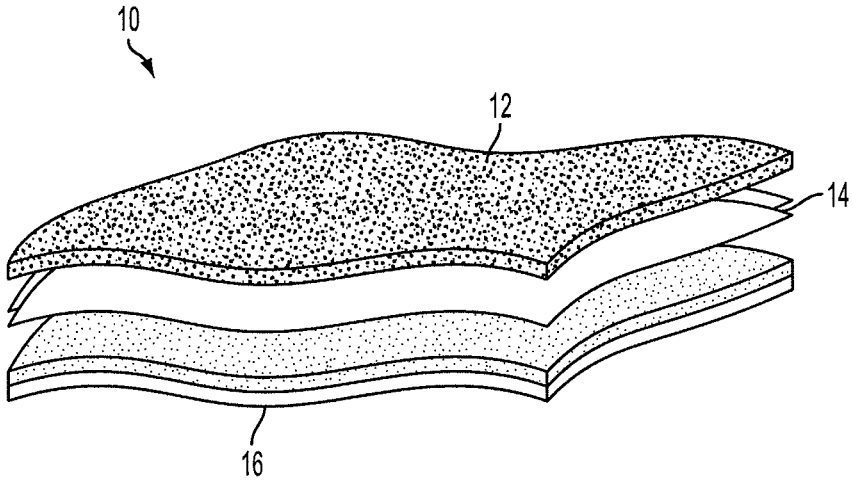
FIG. 1 is an exploded view of a pad according to the present invention.

Various aspects of the invention are described below and/or shown in the drawings. These aspects of the invention may be used alone and/or in any suitable combination with each other. Aspects of the invention are not limited in any way by the illustrative embodiments shown and described herein.

Embodiments of the invention are directed to a multi-layer steam permeable pad for use with a steam appliance, such as a steam cleaner for a floor or other surface, a steam garment press or a steam iron. The pad reduces the moisture content in the steam emitted from the steam appliance that passes through the pad, enabling the surface being treated by steam (e.g., cleaned, sterilized, sanitized, pressed, freshened) to dry quickly.

As shown in FIG. 1, the pad 10 includes a quick drying steam permeable outer fabric layer 12 that may be especially constructed and arranged for the particular steam treatment application. For example, and without limitation, in a pad for use with a steam floor mop or other steam cleaning appliance, the outer layer may be configured to attract dirt, dust, hair and other debris and, or in addition, to soak up stains, liquids and other messes. In one embodiment, the outer layer is a quick drying, steam permeable, knitted microfiber polyester fabric (150D/144F) formed of a backing surface and an array of twisted loops (0.025 inch) extending away from the backing surface. The outer layer preferably is soft so that a cleaning movement, such as wiping back and forth or in a circular path, does not scratch or otherwise damage the floor or surface.

The pad also includes a steam management system for reducing the moisture content in the steam that ultimately permeates the outer layer and reaches the floor or other surface being treated. The steam management system may include a woven microfiber terry fabric layer 14 for moisture absorption. The steam management layer may further include a sandwich layer 16 having a microfiber jersey layer, a knit cushion layer, and a porous mesh layer. The sandwich layer preferably is a unitary construct where the individual layers are laminated together, such as by fusion although other layer connecting techniques are contemplated such as knitting or adhesive bonding the layers together. The steam management system is located internal of the outer layer (e.g., between the outer layer and the point of introduction of steam into the pad), so that the steam that permeates the outer layer will first pass through the steam management system, leading to a reduced moisture content in the steam applied to the floor and faster drying of the treated surface. In one embodiment, the terry layer is a short loop microfiber polyester terry fabric (150D/288F) and the sandwich layer includes a microfiber polyester jersey, a polyester cushion style knit, and an open polyester mesh. Preferably, the sandwich layer is oriented within the pad with the jersey layer facing the terry layer. In other embodiments, the sandwich layer may be flipped with the porous mesh facing the terry layer.

The quick drying steam permeable outer fabric layer, terry fabric layer, and sandwich layer are united together, preferably by a brushed tricot binding extending about the perimeter of the pad. Although the outer fabric layer, terry fabric layer, and sandwich layer are shown as substantially coextensive in shape, the invention is not so limited and different shaped and/or sized layers are contemplated. Additional or alternative interlayer connections may be provided; for example, a stitch line may run along the center of the pad. Other arrangements for joining the layers together are contemplated as should be apparent to one of skill in the art. One or more other layers and/or other components and coatings may be employed in the pad. Such additional layer(s) may be positioned between any of the outer fabric layer, terry fabric layer and sandwich layer, external of the outer fabric layer and/or internal of the sandwich layer. Coatings may be applied to any of the layers, including coatings that enhance attraction of dirt, dust, and debris by the outer fabric layer, coatings that further enhance moisture retention by any of the layers, coatings that facilitate sliding of the outer fabric layer across the surface being cleaned, and coatings that otherwise facilitate any other performance characteristic of the pad. Although the various layers have been described as being formed of polyester fibers, the invention is not so limited as should be apparent to one of skill in the art and other fibers may be employed including, but not limited to, fibers formed of nylon, polyamide and cotton, and blends of any of the foregoing (including polyester). Preferably, at least the outer fabric layer and the terry layer are formed of microfibers.

The pad may be arranged to mount to a frame or head of the steam appliance. In one embodiment, a band or other form including one aspect of a hook and loop type fastener (i.e., either the hook or the loop) may be fixed in one or more locations on the pad to mate with a complementary aspect of the hook and loop type fastener on the frame or head. Other fastener arrangements, such as snaps, clips, hooks, laces and straps, to name but a few, may be employed as should be appreciated by one of skill in the art. In one embodiment, a border segment of the pad is elasticized so that the border segment can be enlarged to slip over the steam frame or head which, upon release, can then spring back to a smaller profile that engages with the frame or head. In a still further embodiment, a border segment of the pad may be flipped over the head or frame and secured in place by hooks, clamps, or other fastening arrangements on the head or frame.

Testing has established that the steam permeable pad according to the present invention provides unexpectedly superior floor drying times. A control pad was formed of an outer fabric layer and a sandwich layer. An embodiment of the inventive pad included the same outer fabric layer and sandwich layer as the control pad, and further incorporated an intermediate terry layer. Each pad was mounted to the cleaning head of the same model steam mop and then a floor was mopped for successive two (2) minute increments. At the end of each mopping period, the time until the floor visually appeared dry (which was confirmed by wiping with a tissue) was measured. As can be seen from the chart below, the embodiment of the inventive pad provided superior floor drying times.

| | Floor Drying Comparison Mop Period (mins) | | | | | | | | | | |
|---|---|---|---|---|---|---|---|---|---|---|---|
| | 2 | 4 | 8 | 12 | 16 | 20 | 24 | 28 | 32 | 36 | 40 |
| Time to Dry: Control Pad (mins) | 3.33 | 1.4 | 2.18 | 6.36 | 5.21 | 7.26 | 9.18 | 9.29 | 10.12 | 10 | 13.14 |
| Time to Dry: Inventive Pad (mins) | 0.53 | 1.1 | 1.5 | 1.51 | 2.45 | 2.18 | 3.14 | 2.3 | 3.15 | 4.5 | 4.37 |

Figure 2:
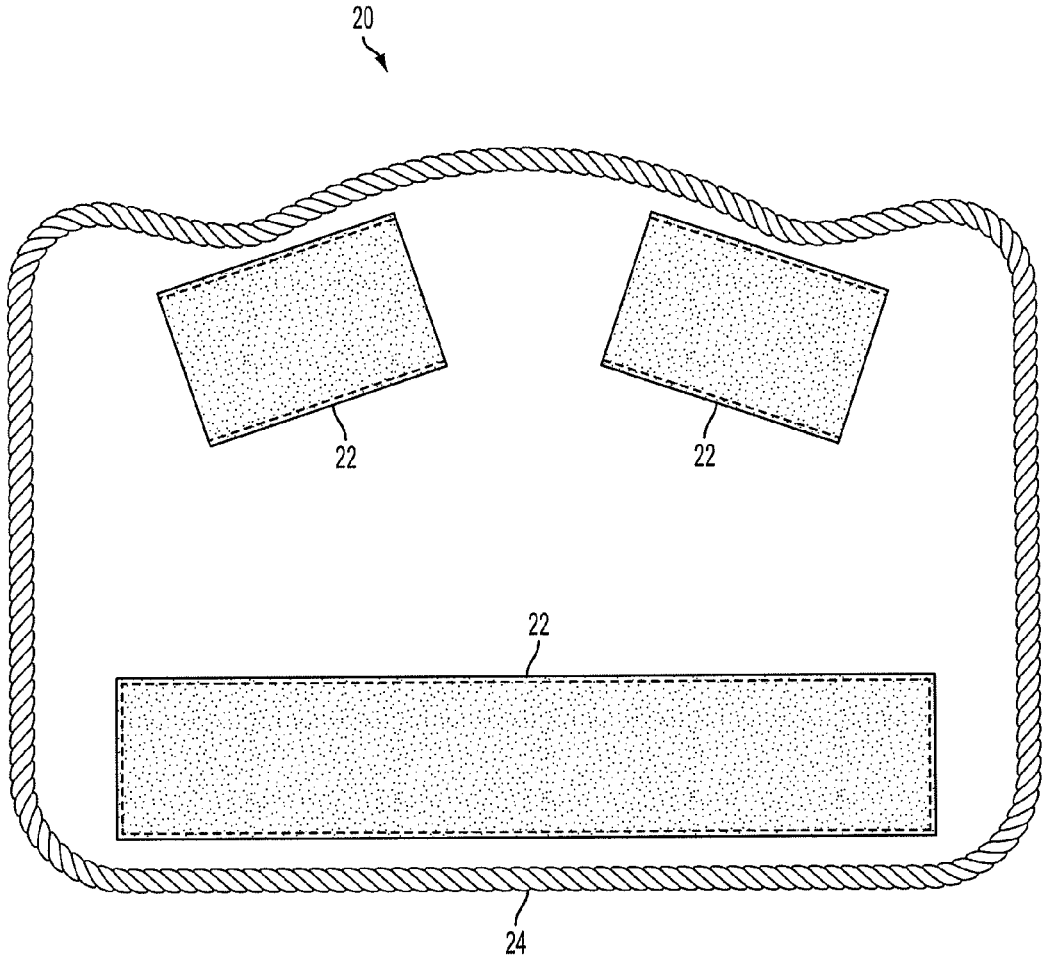
FIG. 2 is a view of a pad according to the present invention configured for mounting to a head or frame of a steam mop.

A representative pad 20 arranged for use with a steam mop is shown in FIG. 2. The steam mop pad may have any shape suitable for use with the steam head or frame of the mop to which it will be attached and is not limited to the shape shown. The pad includes a cleaning surface layer formed of twisted loop polyester microfiber, an intermediate layer of woven microfiber terry fabric, and a sandwich layer of jersey fabric, polyester cushioning knit, and open polyester mesh. A polyester twill binding 24 runs around the perimeter of the pad, and a center stitch line extends through all of the layers. Several bands 22 of hook or loop type fastener are stitched to the side of the pad opposite the outer cleaning layer. The fastener bands are attachable to complementary fastener bands on the steam head or frame of the mop. Steam emitted from the head or frame will disperse through the sandwich layer, and moisture in the steam will be trapped or otherwise reduced by the terry layer. Some steam reduction may also occur in the sandwich layer. The steam that passes from the terry layer and permeates the cleaning surface outer layer will be drier than the steam that first entered the pad, assuring quicker disappearance of water streaks on the floor surface.

The steam permeable pad may assume, or constitute, a three dimensional configuration as well. As an example, the pad may be in the form of a pouch or pocket having an open end and a closed end. The pocket may be fitted over a frame so that the pocket cooperates with the frame to define a steam chamber. The pocket provides additional cleaning surfaces and the ability to clean opposed or adjacent surfaces in a single movement. The arrangement of layers in the pocket is the same as in the steam mop floor pad just described with the pathway and management of steam also being similar. Other shapes and arrangements of the pocket are contemplated as should be apparent to one of skill in the art.

The above and other aspects of the invention will be appreciated from the detailed description and claims. It should be understood that although aspects of the invention have been described with reference to illustrative embodiments, aspects of the invention are not limited to the embodiments described. Also, aspects of the invention may be used alone, or in any suitable combination with other aspects of the invention.

What is claimed is:

1. A pad for mounting to a head or a frame of a steam appliance, comprising:

a steam permeable pad body having a steam treatment surface portion and a steam introduction portion, said pad body including a steam permeable outer fabric layer and a steam permeable terry fabric layer, said steam permeable terry fabric layer located between said steam introduction portion and said outer fabric layer, said outer fabric layer including an array of microfiber twisted loops and having a drying time quicker than said terry fabric layer, said pad body including an attachment feature to mount to a head or a frame of a steam appliance.

2. The pad of claim 1, further including a steam permeable sandwich layer comprising a jersey fabric layer, a cushioning fabric layer, and a mesh fabric layer.

3. The pad of claim 2, wherein said jersey fabric layer faces said terry fabric layer.

4. The pad of claim 1, wherein said terry fabric layer is formed of microfibers.

5. The pad of claim 1, wherein said attachment feature includes a portion of a hook and loop fastener system.

6. The pad of claim 1, wherein said attachment feature includes a border portion of said pad body.

7. The pad of claim 1 in combination with a steam appliance.

8. The pad of claim 1 in which the outer fabric layer includes a backing surface and the twisted loops extend about 0.025 inches from the backing surface.

9. A pad for mounting to a head or a frame of a steam appliance, comprising:

a steam permeable outer fabric layer;

a fabric-based steam management system to remove moisture from steam admitted into said pad before it reaches said steam permeable outer layer said outer fabric layer including an array of microfiber twisted loops and having a drying time quicker than said fabric-based steam management system; and an attachment feature to mount said pad to a head or frame of a steam appliance.

10. The pad of claim 9, wherein said fabric-based steam management system includes a microfiber terry fabric layer.

11. The pad of claim 9, further including a multi-layer fabric laminate.

12. The pad of claim 9, wherein the multi-layer laminate includes a jersey fabric, a cushioning fabric layer, and a mesh fabric.

13. The pad of claim 9 in combination with a steam appliance.

14. The pad of claim 9 in which the outer fabric layer includes a backing surface and the twisted loops extend about 0.025 inches from the backing surface.

* * * * *